United States Patent [19]

Ramdohr et al.

[11] 4,392,369

[45] Jul. 12, 1983

[54] DIAGONAL ROLLING OF HOLLOW STOCK

[75] Inventors: Detlef Ramdohr, Krefeld; Walter Knauf; Karl-Heinz Brensing, both of Düsseldorf; Rolf Kümmerling, Essen, all of Fed. Rep. of Germany

[73] Assignee: Mannesmann Aktiengesellschaft, Düsseldorf, Fed. Rep. of Germany

[21] Appl. No.: 246,178

[22] Filed: Mar. 23, 1981

[30] Foreign Application Priority Data

Apr. 1, 1980 [DE] Fed. Rep. of Germany ..... 3013127

[51] Int. Cl.[3] ..... B21B 19/06

[52] U.S. Cl. ..... 72/96; 72/98

[58] Field of Search ..... 72/78, 95, 96, 97, 98, 72/100

[56] References Cited

U.S. PATENT DOCUMENTS

| | | | |
|---|---|---|---|
| 817,796 | 4/1906 | Nicholson | 72/97 |
| 1,897,770 | 2/1933 | Severin | 72/96 |
| 2,060,768 | 11/1936 | Assel | 72/96 |

FOREIGN PATENT DOCUMENTS

| | | | |
|---|---|---|---|
| 427843 | 11/1948 | Italy | 72/97 |

*Primary Examiner*—Lowell A. Larson

*Attorney, Agent, or Firm*—Ralf H. Siegemund

[57] ABSTRACT

Diagonal rolls for stretching hollows are of a truncated-cone-like configuration, each with two shoulders and a recess in between, for cooperation with a cylindrical mandrel rod in order to obtain a two-stages-in-one reduction in wall thickness; the shoulders merge in smoothing surfaces.

3 Claims, 1 Drawing Figure

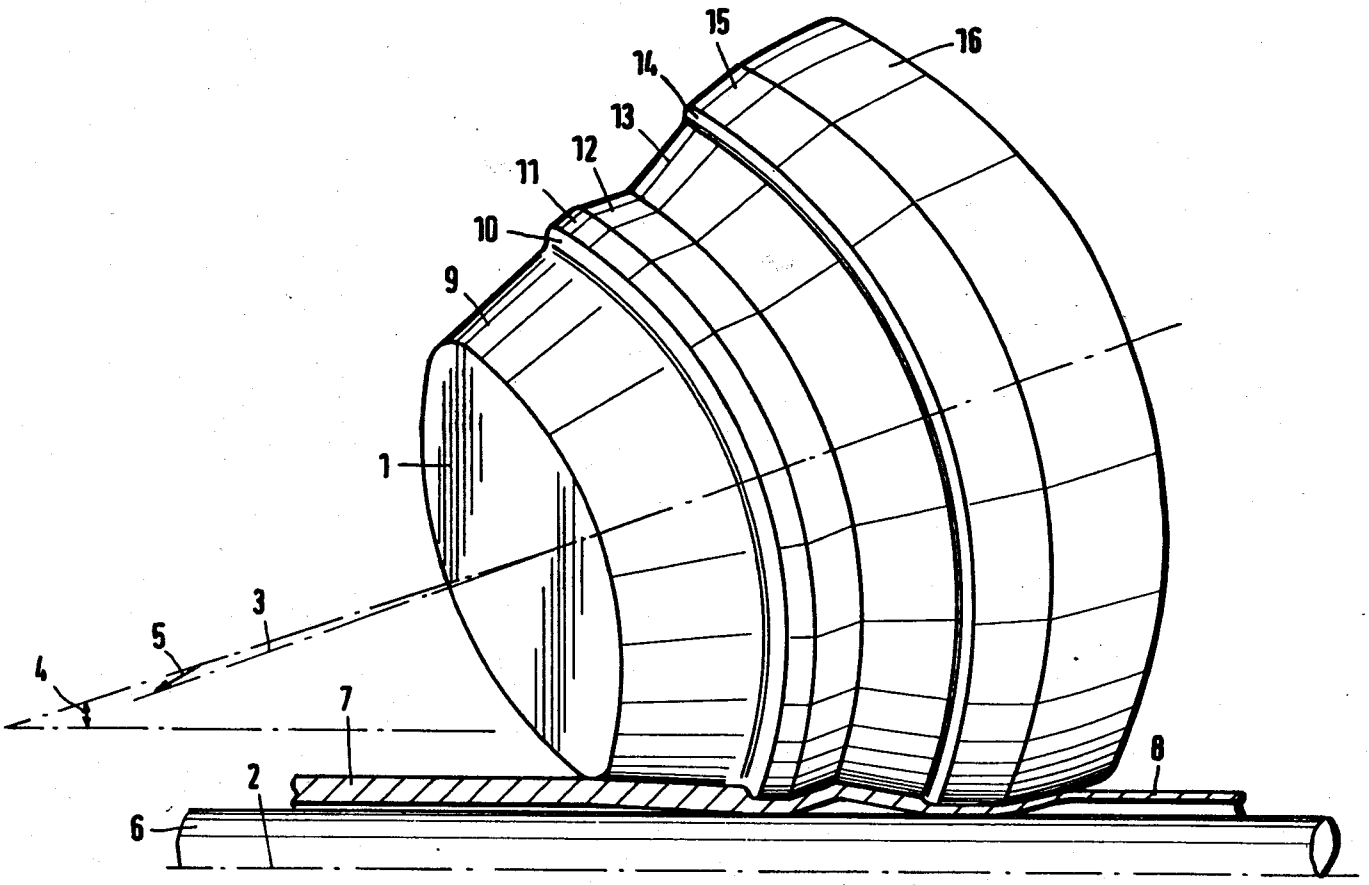
16
15
14
13
12
11
10
9
1
3
5
4
7
8
2
6

DIAGONAL ROLLING OF HOLLOW STOCK

BACKGROUND OF THE INVENTION

The present invention relates to rolling seamless hollow stock for purposes of making seamless tubes by means of diagonal rolling, using frustoconical rolls.

German Pat. No. 174 372 disclosed a mill, using two or more obliquely oriented rolls of frustoconical or truncated-cone-like configuration. These rolls are arranged in a common plane of rolling, and they are oriented so that the thick end of each roll is located downstream as far as the movement of the rolled stock is concerned. The oblique orientation follows particular rules; its angle with reference to a first plane, that includes the axis of rolling; establishes the transport angle, while the angle relative to a second plane, which includes also the axis of rolling and is oriented orthogonally to the first plane, is the spreading angle, being approximately half the apex angle of the frustocone. The frustoconical surface of the roll can be subdivided into a concial feed or entrance portion, thicker and thinner portions (with reference to an ideal cone) and an exit or discharge portion at the thicker end of the cone. These rolls cooperate with a piercing mandrel.

Pipes made in that manner are usually subsequently sized, also by diagonal rolls, and they are further stretched. Sizing and stretching is also used for making tubes from hollows which have been produced initially otherwise. The hollow blooms that are to be made are destined, e.g., for final wall thickness-to-diameter ratios of 1:15, or even thicker pipes, possibly being hollow blanks to be subsequently sized in pilger mills (reciporcating step rolling), or in a continuously working sizing mill, or stretching in a push-bank.

It has been suggested to make thin-walled, seamless pipes by stretching hollows, e.g., by means of multipass or multistand rolling, using rather small stretch values per pass or per stand and using diagonal rolls, possibly with a sizing shoulder. All of these proposals have not been realized in practice. It is believed that the thermal conditions interfer technologically with the desired goal of stretching. See, for example, German Pat. No. 926 541 or German printed patent application No. 960 328.

DESCRIPTION OF THE INVENTION

It is an object of the present invention to improve seamless pipe-making technology, based upon the earlier proposals for thick-walled pipes, but improving them to permit the making of a thin-walled pipe (wall thickness-to-diameter ratio smaller than 1:15) in a simple process and in a single pass.

It is a specific object of the present invention to provide a new and improved diagonal rolling mill for stretching hollows, using truncated cones as rolls, the rolls being obliquely oriented to the axis of rolling by the transport and spreading or twist angles; the smaller end of each truncated cone faces the oncoming hollow.

In accordance with the preferred embodiment of the invention, it is suggested to provide each of the rolls with two annular shoulders, preferably of different height, and being separated by a recess which includes a conical run-up or feed surface to the second shoulder. Preferably, sizing surfaces are provided immediately downstream from each shoulder. These rolls cooperate with a cylindrical mandrel rod, i.e., a cylindrical, inside tool of which different portion but of the same diameter are located opposite the two shoulders of any of the rolls.

These two shoulders establish two deformations of the hollow, in a single pass, and at such a short distance as between the deformation zones that there is interaction between them. This permits the making of thin-walled tubing, whereby particularly a larger reduction of the wall thickness is feasible as compared with the prior art methods. Shoulders in rolls are known per se, the inventive combination of two shoulders and the resulting two-step-in-one stretch operation permits the making of thinner tubes than was heretofore possible.

DESCRIPTION OF THE DRAWING

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawing, in which:

the FIGURE shows a roll for and in a mill in accordance with the preferred embodiment of the present invention for practicing the best mode thereof.

The FIGURE shows, in particular, a diagonal roll 1; the journal ends have been omitted. Also, mounting and drive of this roll are conventional and are, therefore, not shown. The mill is comprised of at least two such rolls which are disposed for rolling in a common plane transversely to the rolling axis 2.

Reference numeral 3 refers to the axis of roll 1, being inclined by an angle 4 relative to axis 2. This angle 4 defines the spreading angle or angle of twist and is approximately half the cone angle of the overall surface contour or roll 1. The arrow 5 denotes the fact that the axis 3 is actually obliquely disposed. Thus, the angle 4 is actually the angle between a projection of axis 3 into a plane (the plane of the drawing) that includes the axis 2. Arrow 5 stands in representation of the transport angle. The roll 1 (as well as the second one of the mill) cooperates with a cylindrical mandrel rod 6. The mandrel rod extends in cantilever fashion from a thrust mount, either at the entrance side or at the exit side of a hollow 7 to be rolled into a thin-walled tube 8. Alternatively, the mandrel rod may float in the hollow.

The rod 6 may turn on its own axis during rolling and be stationary axially, or it may move axially in the direction of rolling or oppositely thereto. It is important that this internal tool 6 has a uniform, circular contour wherever it faces working portions of the roll. During operation and rolling, the hollow 7 enters the mill, in the drawing from the left and moves toward the right.

The roll 1 itself is of overall truncated-concial or frustoconical configuration. In detail, the small end of that truncated cone is comprised of an entrance or feed cone 9 (truncated) which engages the hollow 7 and any portion thereof initially. This cone pushes the material of hollow 7 against a first shoulder 10. Since the hollow undergoes a corkscrew or helical motor; a smoothing surface 11 is provided directly downstream from shoulder 10. This surface 11 on a ridge provides for an equalization of the now thinner wall of the hollow.

As a consequence of the combined action of shoulder 10 and ridge surface 11, the hollow is not only locally stretched, but also its diameter is increased. Accordingly, an annular recess portion 12 is provided in the roll so that the material can be displaced into that recess space, but in a controlled manner. A second entrance or feed cone 13 is provided as the downstream part of recess 12, which second cone forces the material against a second shoulder, 14. Again, a smoothing portion and annular ridge 15 is provided directly downstream from the shoulder 14. The working surface of roll 1 includes, finally, a rounding portion 16 which is conventional. This portion does not participate directly in the stretching of the tube, now tube 8, but equalizes the enlarged diameter thereof.

In view of the deforming of the stock being rolled, one has to observe that the material is held back at the shoulders of the roll so that the stretching at the second shoulder 14 has to match the relative diameter increase of the roll from the first (10) to that second shoulder. It was found that the diameter increase of shoulder 14 with reference to the diameter of shoulder 10 should correspond at least to one-third of the desired relative length increase (stretching) of the hollow at and beyond the second shoulder 14.

The final tube 7 has a thinner wall than is made possibly by conventional diagonal rolling mills; but it matches in quality all of the rather high demands.

In the preferred form, the shoulder heights (of shoulders 10 and 14) should be about 2:1. The shoulders should have an angle of about 30° relative to the axis of rolling (and of the hollow), and their dimensions are in the range of from approximately 3 mm to approximately 11 mm, there being correspondingly smooth transitions to the adjacent working surfaces.

Shoulders of the type specified cause a relative large deformation over a relatively short length and the material is correspondingly heated. Since the two shoulders are axially rather closely spaced, relatively little heat is conducted away from the material into the roll and the mandrel rod, particularly in and from the range from the first shoulder 10 to the second shoulder 14. Thus, the technological treatment of the material of the hollow is quite favorable. Moreover, the mill is simpler as compared with known diagonal mills because one uses a cylindrical mandrel rod. Any particular adjustment of a particular portion of the mandrel relative to the rolls is not necessary. This facilitates the operation, particularly as far as subsequent adjustment during rolling is concerned. Also, the rod, having a uniform diameter can be longitudinally adjusted, repositioned, or even more freely in axial direction.

The leading end of the pipe-hollow (7) runs against the first shoulder which does not present any problems even for rather thick hollows. As soon as the ground shoulder (14) engages the hollow, tension is exerted upon the hollow resulting from the relief recess 12 and the large rolling diameter at shoulder 14 (portion 15!) so that the wall thickness of the hollow is reduced thereat, and the hollow is prevented from deviating (too much) from a round cross sectional contour. Also, material will not be dislodged between the rolls and cause any breakdown.

The discharge of the now thin wall of tube 7 fails likewise to cause any problems because the second shoulder stretches significantly less and, thus, deforms the material to a relatively small extent. This is accomplished by a smaller shoulder height, as was already mentioned earlier. The procedure contrasts favorably with rolling on prior-art mills, using but one shoulder.

The two smoothing portions 11 and 15 should be provided and proportioned in order to offer a constant (radial) spacing relative to mandrel rod 6. Also, these shoulder extensions will grip the hollow more firmly and define definite radial spacing relatively to the uniform diameter mandrel rod.

The invention is not limited to the embodiments described above, but all changes and modifications thereof not constituting departures from the spirit and scope of the invention are intended to be included.

We claim:

1. In a diagonal rolling mill for stretching seamless hollows, using at least two rolls of overall truncated configuration, being arranged in a common plane of rolling transverse to an axis of rolling and having obliquely disposed axes, further being oriented so that a smaller end of each of the rolls faces the oncoming hollow, the improvement comprising, in combination, each of the rolls having:

a first annular, radially projecting working shoulder, projecting from the conical smaller end;

a second, larger, annular, radially projecting working shoulder;

an annular recess between the shoulders and a conical surface as transition from the recess to the second shoulder; and a circular cylindrical mandrel rod for coaction with the rolls, wherein said first shoulder urges material of the hollow against the mandrel for reducing the wall thickness of the hollow and stretching same, said recess receiving material radially displaced because of the stretching, the second shoulder further stretching the hollow, all in coaction with the cylindrical mandrel.

2. In a mill as in claim 1, each of the shoulders having a height, the respective heights of the first and second shoulders being related by about 2:1 ratio.

3. In a mill as in claim 1 or 2, there being an annular smoothing surface at each of the shoulders.

* * * * *